US008028369B2

(12) United States Patent
Chiang

(10) Patent No.: US 8,028,369 B2
(45) Date of Patent: Oct. 4, 2011

(54) MOP AND WRINGER COMBINATION

(76) Inventor: Hsiao-Hung Chiang, Taipei (TW)

( * ) Notice: Subject to any disclaimer, the term of this patent is extended or adjusted under 35 U.S.C. 154(b) by 616 days.

(21) Appl. No.: 12/241,042

(22) Filed: Sep. 30, 2008

(65) Prior Publication Data

US 2010/0077558 A1 Apr. 1, 2010

(51) Int. Cl.
*A47L 13/00* (2006.01)

(52) U.S. Cl. ..... 15/260; 15/119.1; 15/147.1; 15/263

(58) Field of Classification Search ..... 15/260, 15/263, 119.1, 116.1, 120.2, 147.1
See application file for complete search history.

(56) References Cited

U.S. PATENT DOCUMENTS

| | | | | |
|---|---|---|---|---|
| 2,407,421 | A * | 9/1946 | Herold | 403/58 |
| 5,876,141 | A * | 3/1999 | Hsu | 401/207 |
| 5,918,340 | A * | 7/1999 | Young | 15/115 |
| 7,743,528 | B2 * | 6/2010 | Lin | 34/58 |
| 2010/0139020 | A1 * | 6/2010 | Chiang | 15/147.1 |

* cited by examiner

*Primary Examiner* — Robert Scruggs

(57) ABSTRACT

A mop and wringer combination in one embodiment includes a mop comprising a pivotal handle and a mop swab adapted to rotate with respect to the handle; and a wringer comprising a ratchet type mechanism so that a user may press a spring-biased foot step to wring strands of a mop swab disposed in a mop receptacle in a pail via gear connection, release the foot step to return to its initial condition, and repeatedly perform the above two steps until the mop swab is dried.

2 Claims, 17 Drawing Sheets

MOP AND WRINGER COMBINATION

BACKGROUND OF THE INVENTION

1. Field of Invention

The invention relates to floor cleaning equipment and more particularly to a mop and wringer combination with improved characteristics.

2. Description of Related Art

Mops are well known devices. For example, U.S. Pat. No. 6,212,728 discloses a self-wringing ratchet mop which allows a user to grip and rotate a grip sleeve repeatedly until a mop swab is dried.

There have been numerous suggestions in prior patents for mop wringer. For example, U.S. Pat. No. 5,349,720 discloses a mop wringer. But a combination of mop and wringer has not been disclosed so far as the inventor is aware.

SUMMARY OF THE INVENTION

It is therefore one object of the invention to provide a mop and wringer combination.

The above and other objects, features and advantages of the invention will become apparent from the following detailed description taken with the accompanying drawings.

DETAILED DESCRIPTION OF THE INVENTION

Figure 1:
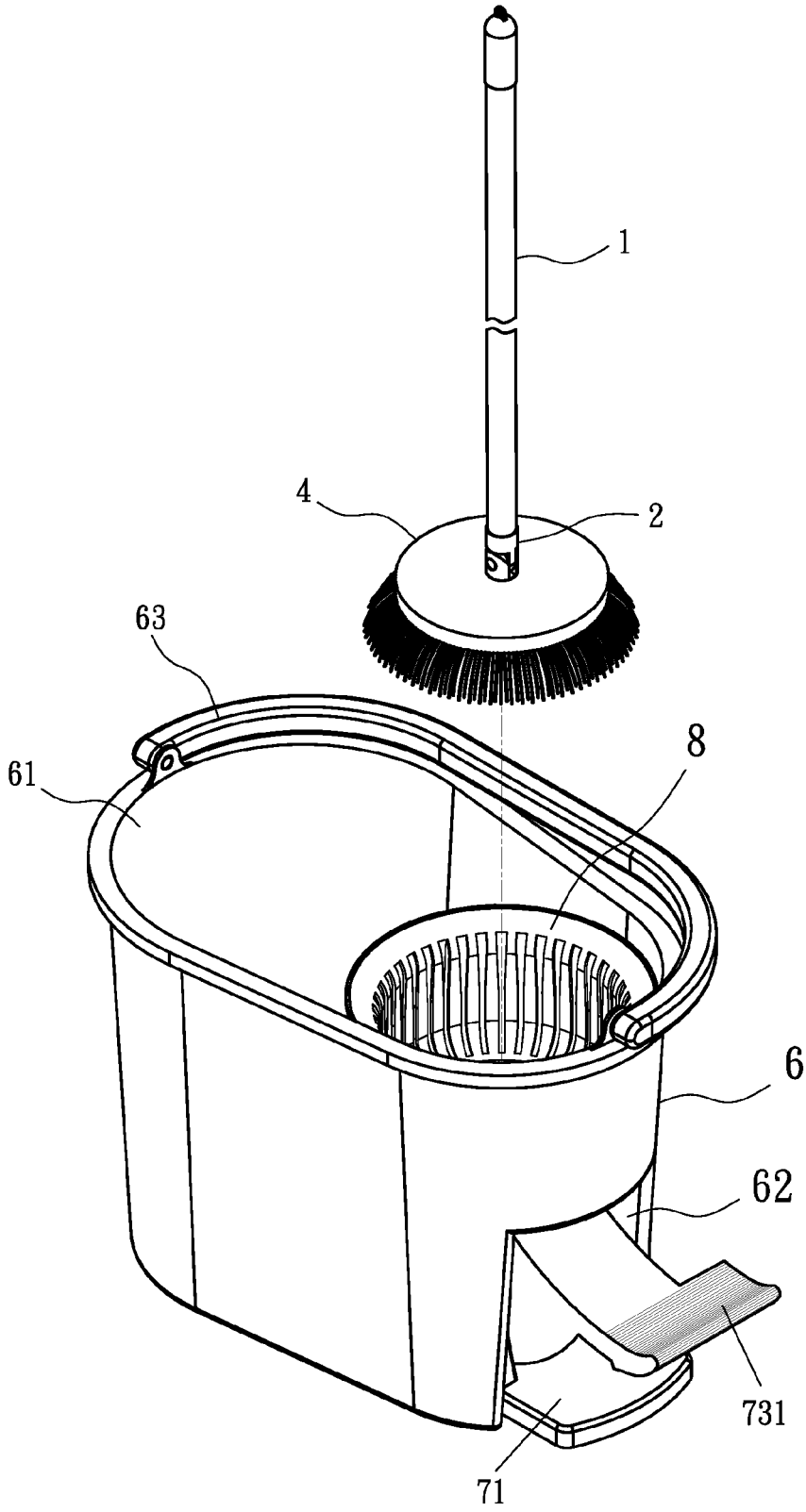
FIG. 1 is a perspective view of a mop and wringer combination according to the invention.
Figure 2:
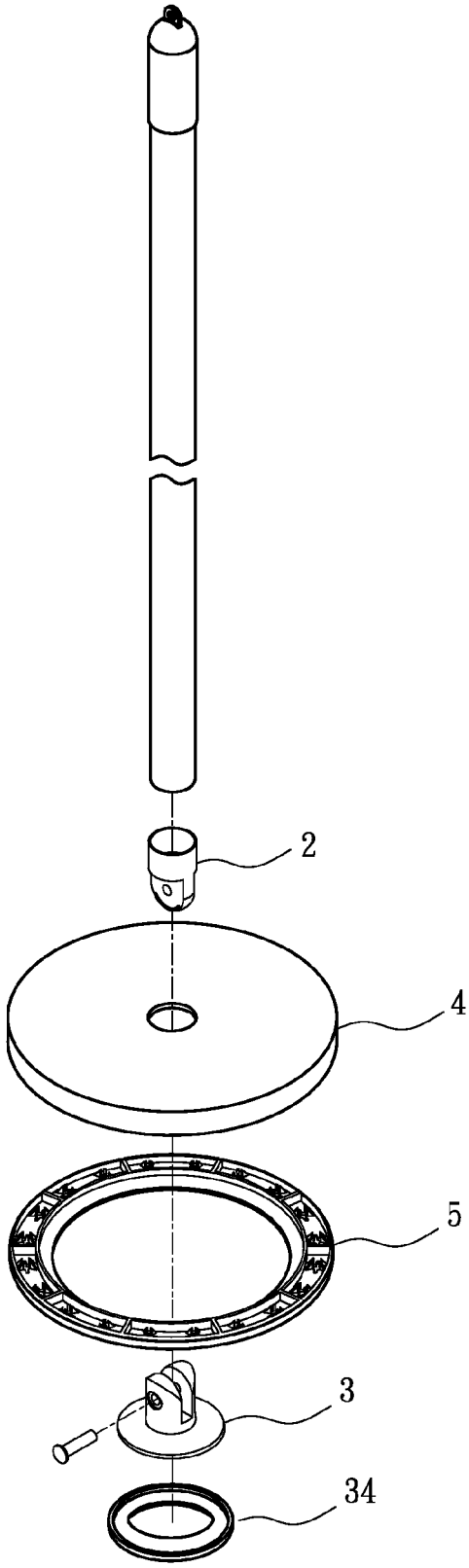
FIG. 2 is an exploded view of some components of the mop.
Figure 3:
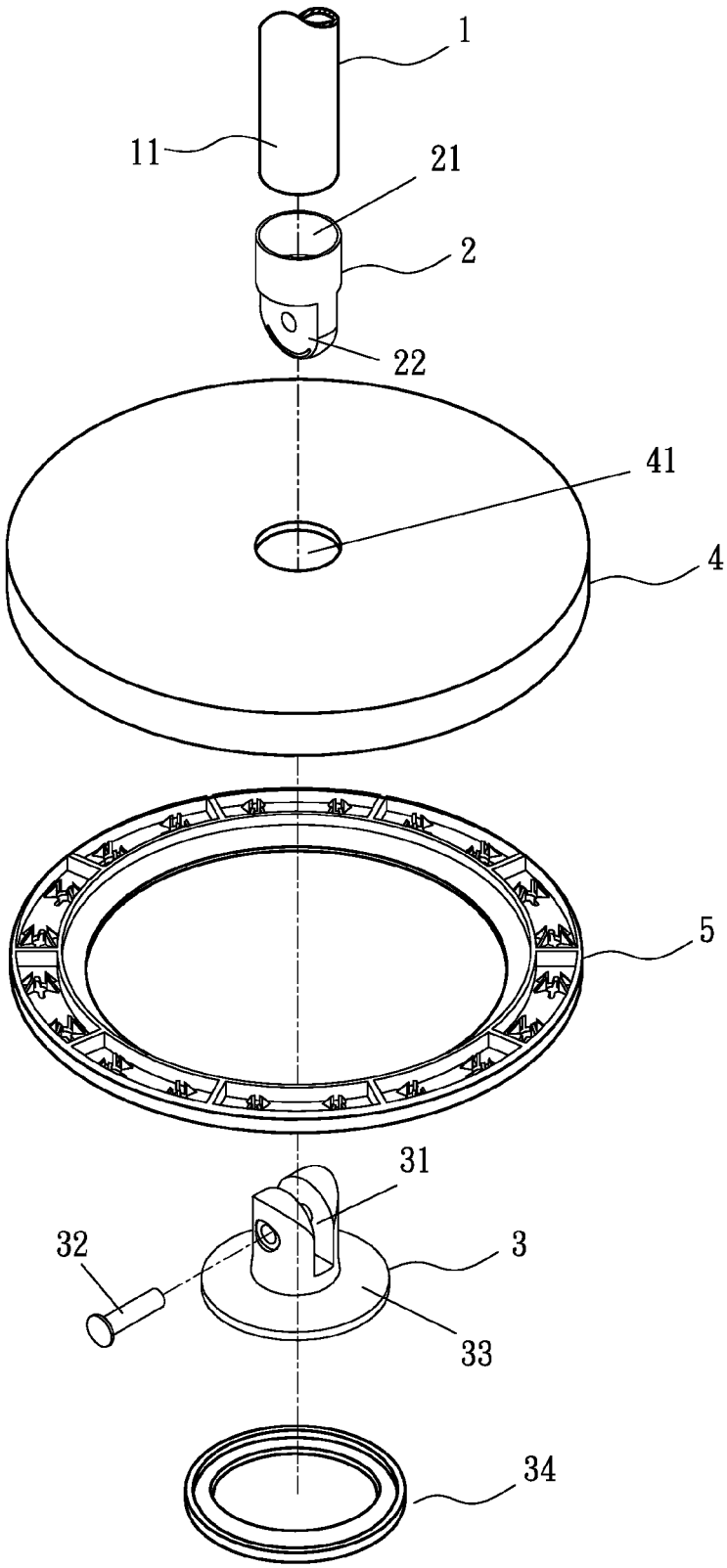
FIG. 3 is an enlarged view of FIG. 2.
Figure 4:
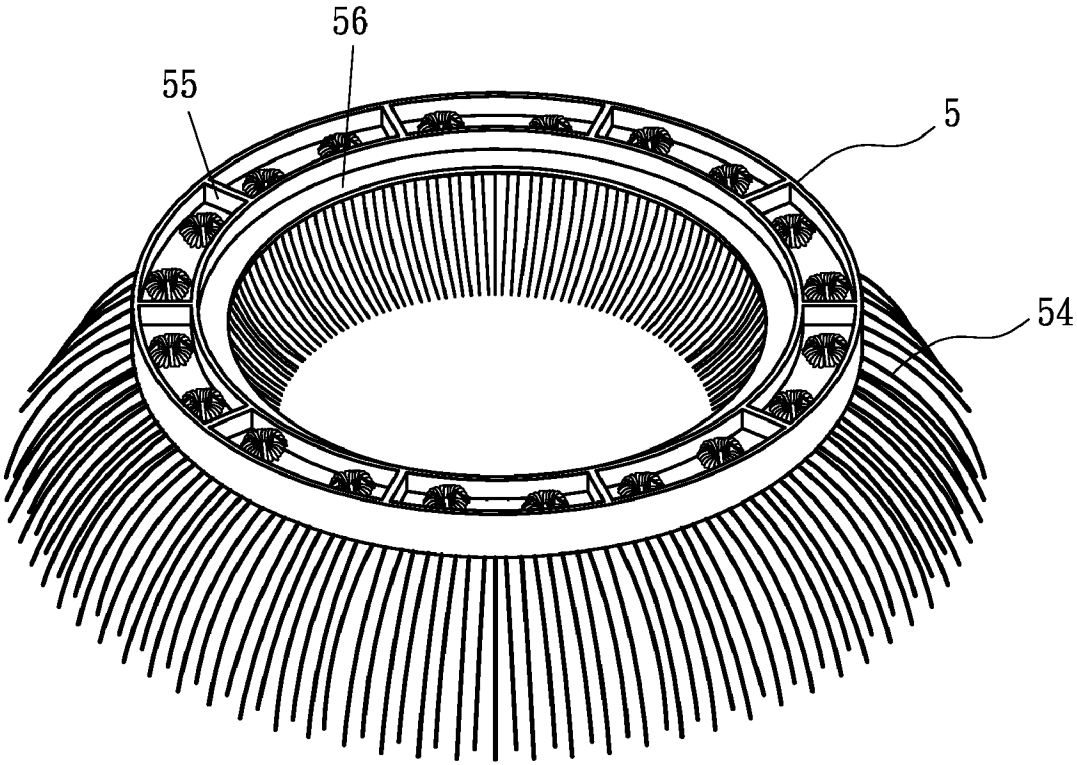
FIG. 4 is a perspective view of the mop swab.
Figure 5:
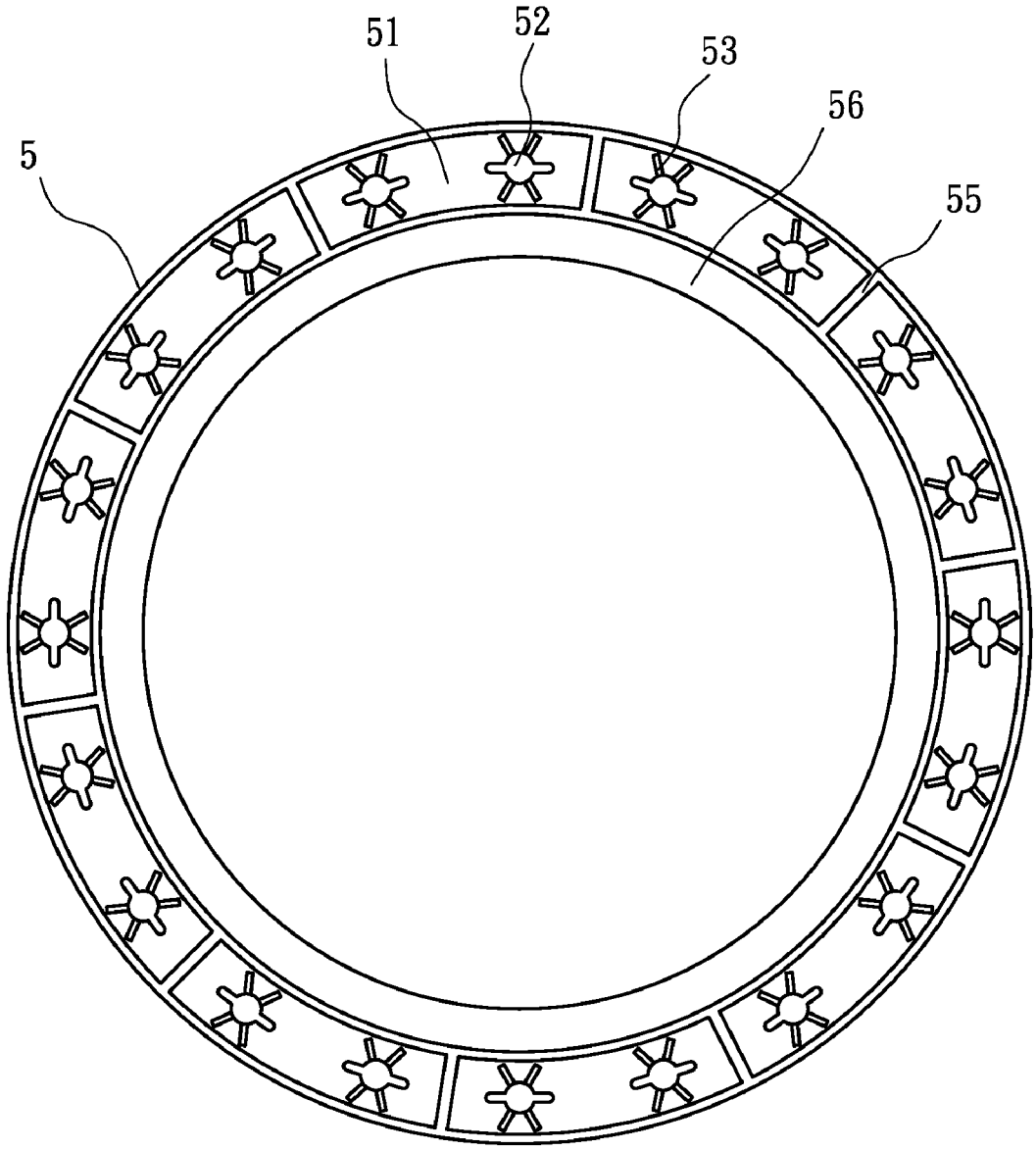
FIG. 5 is a top view of FIG. 4 with the mop strands being removed.
Figure 6:
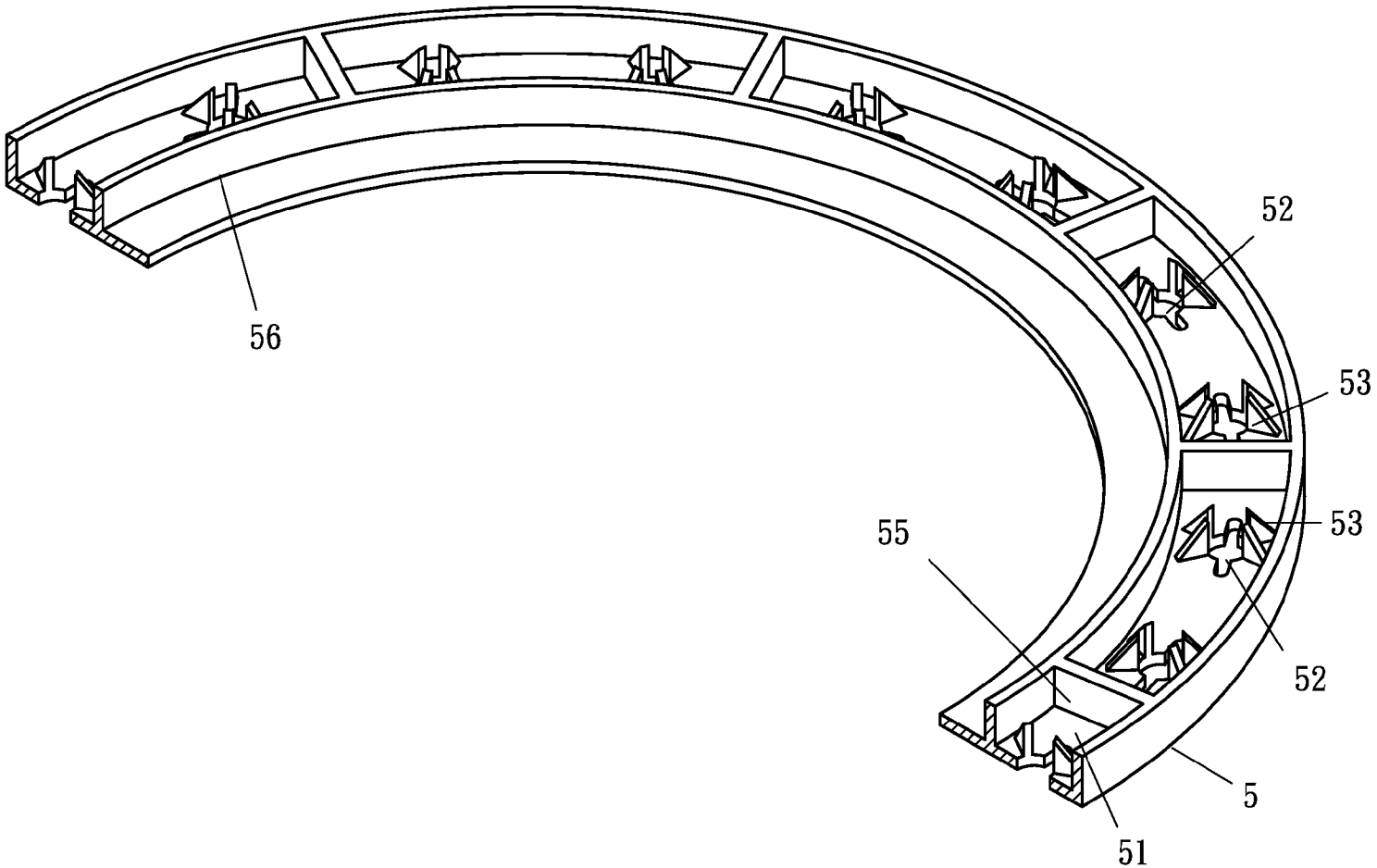
FIG. 6 is a broken-away perspective view of FIG. 5.
Figure 7:
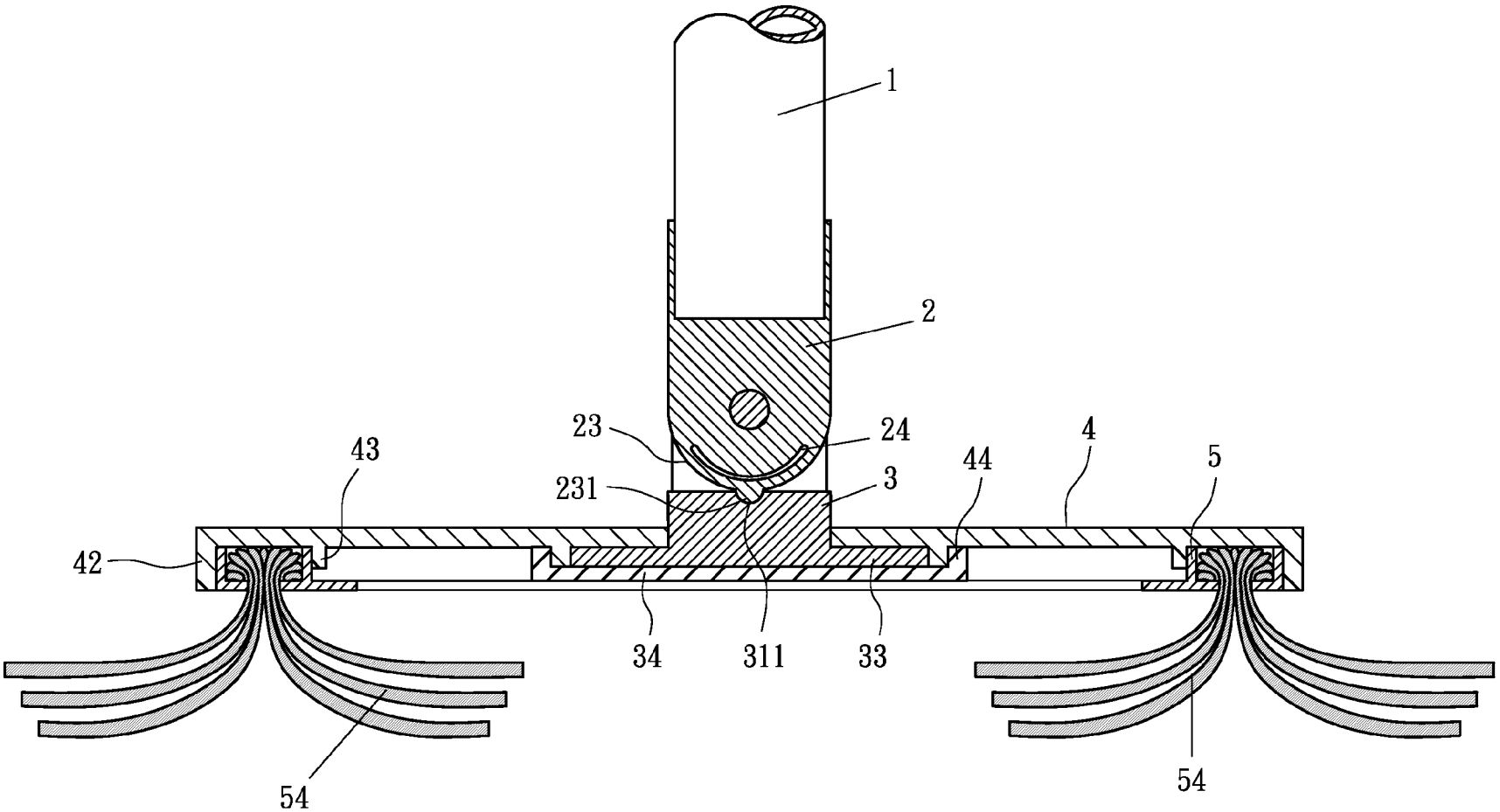
FIG. 7 is a longitudinal sectional view of a lower portion of the mop of FIG. 1.
Figure 8:
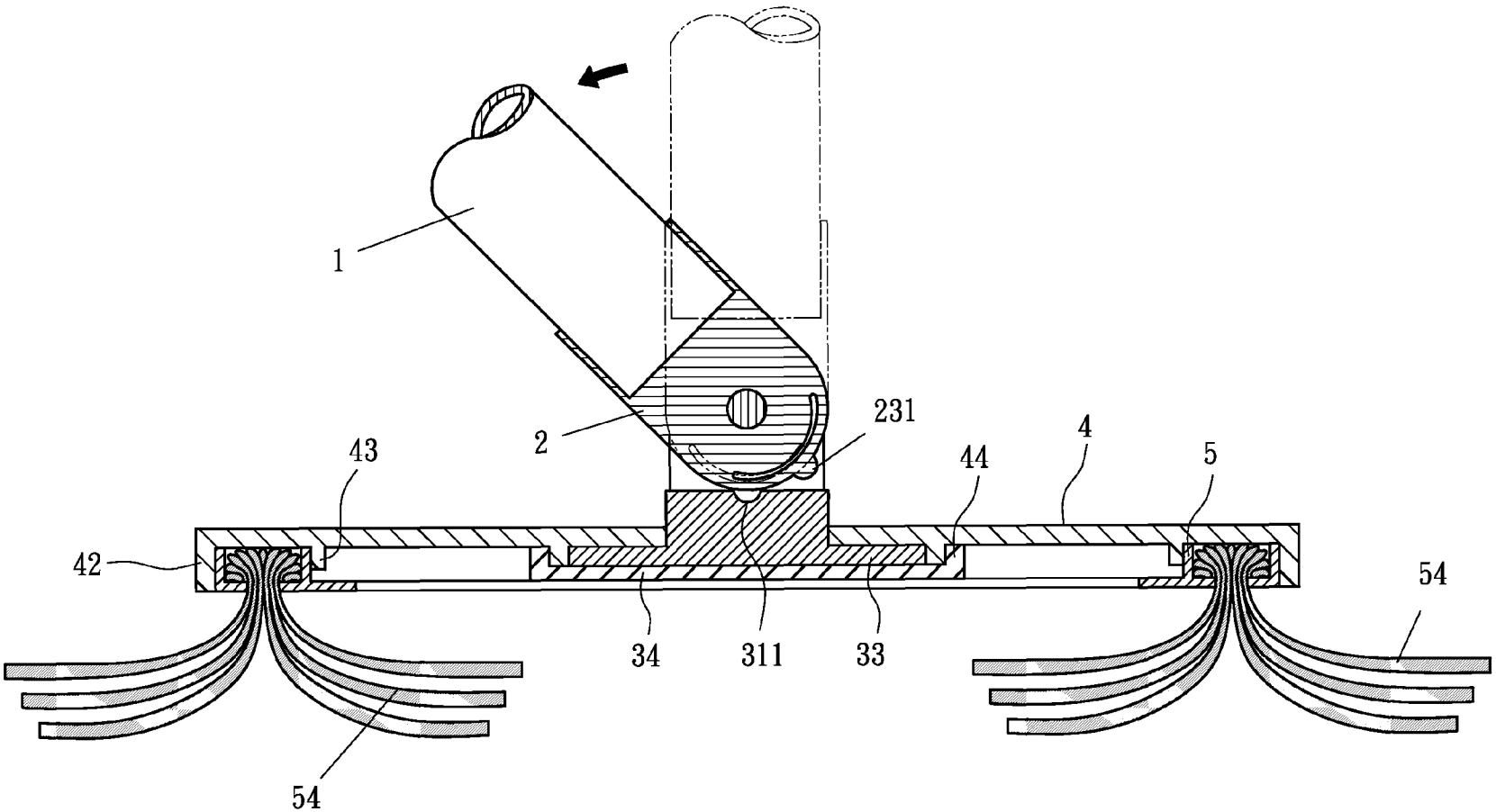
FIG. 8 is a view similar to FIG. 7 where the handle is disposed in an inclined position after pivoting.
Figure 9:
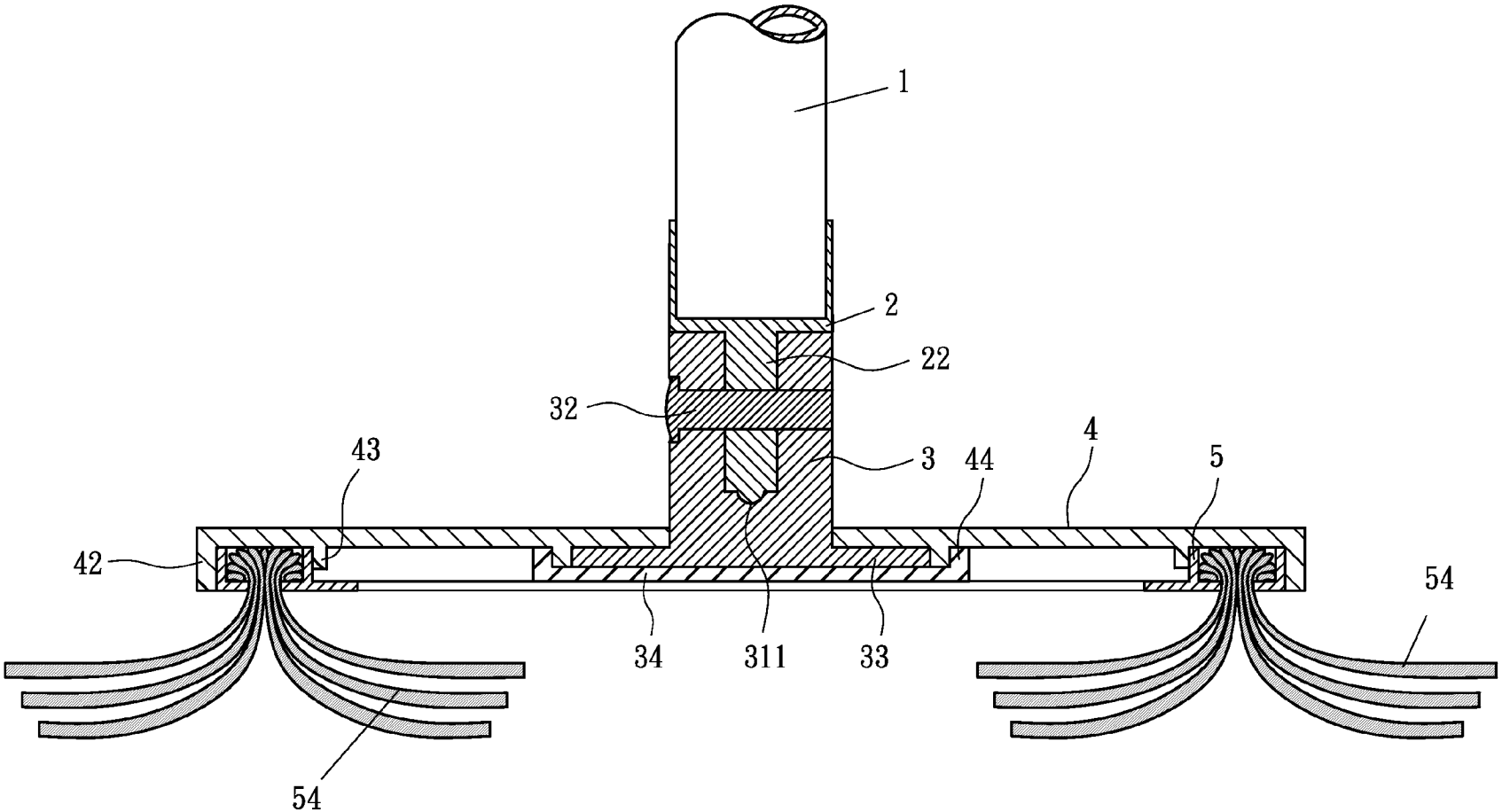
FIG. 9 is another longitudinal sectional view of the lower portion of the mop of FIG. 1.
Figure 10:
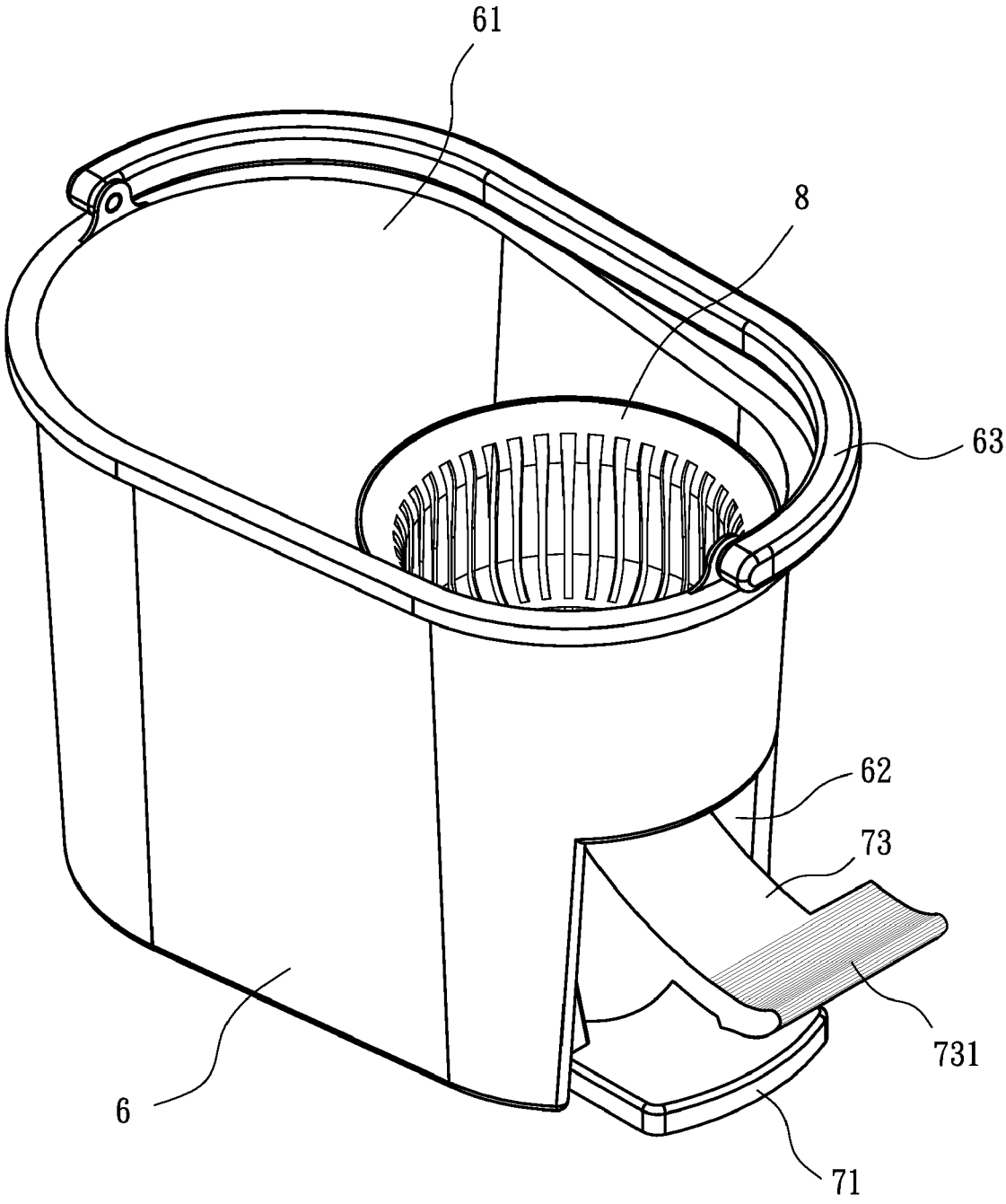
FIG. 10 is a perspective view of the wringer of FIG. 1 but shown in an enlarged view, the wringer being constructed in accordance with a first preferred embodiment of the invention.
Figure 11:
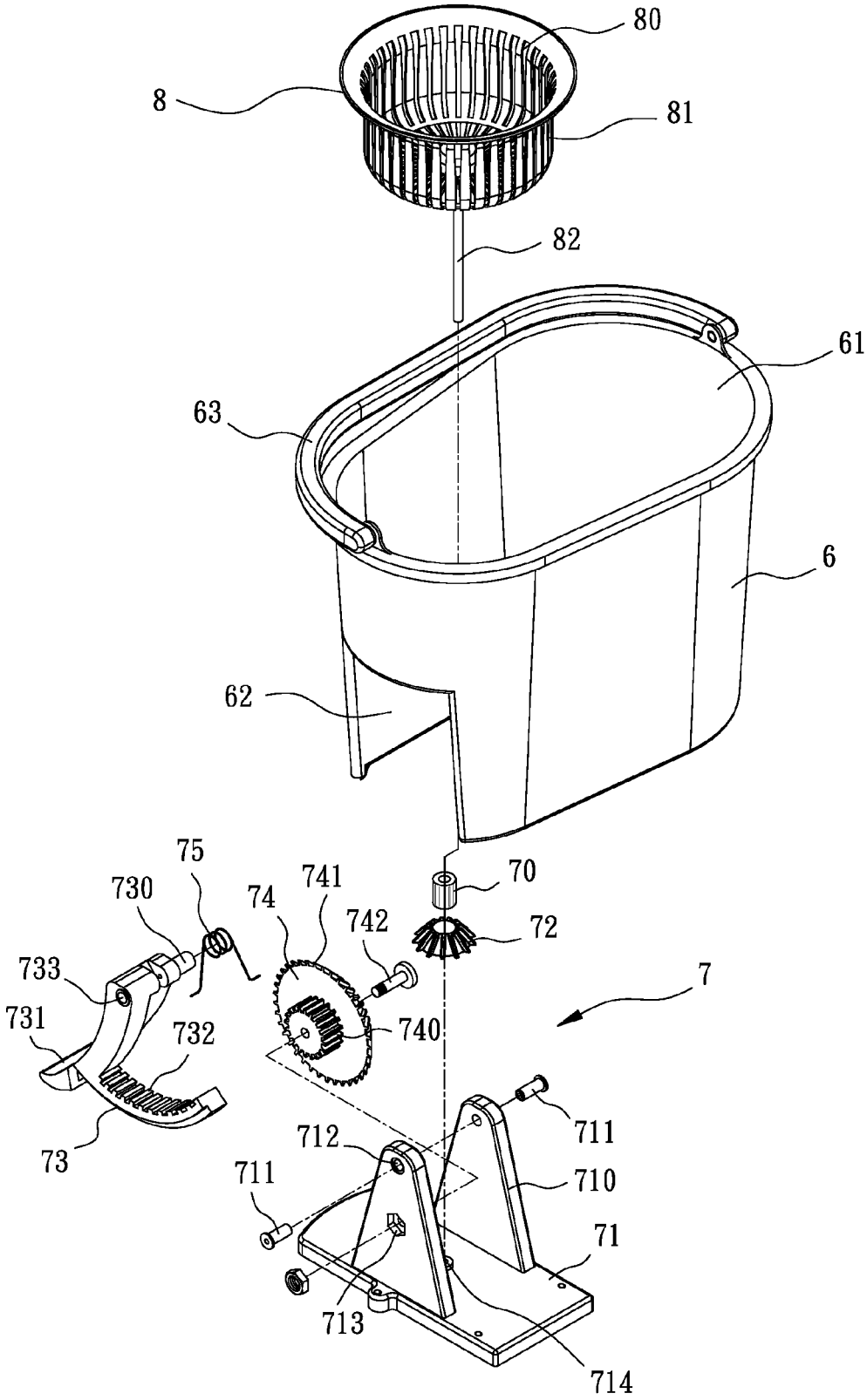
FIG. 11 is an exploded view of FIG. 10.
Figure 12:
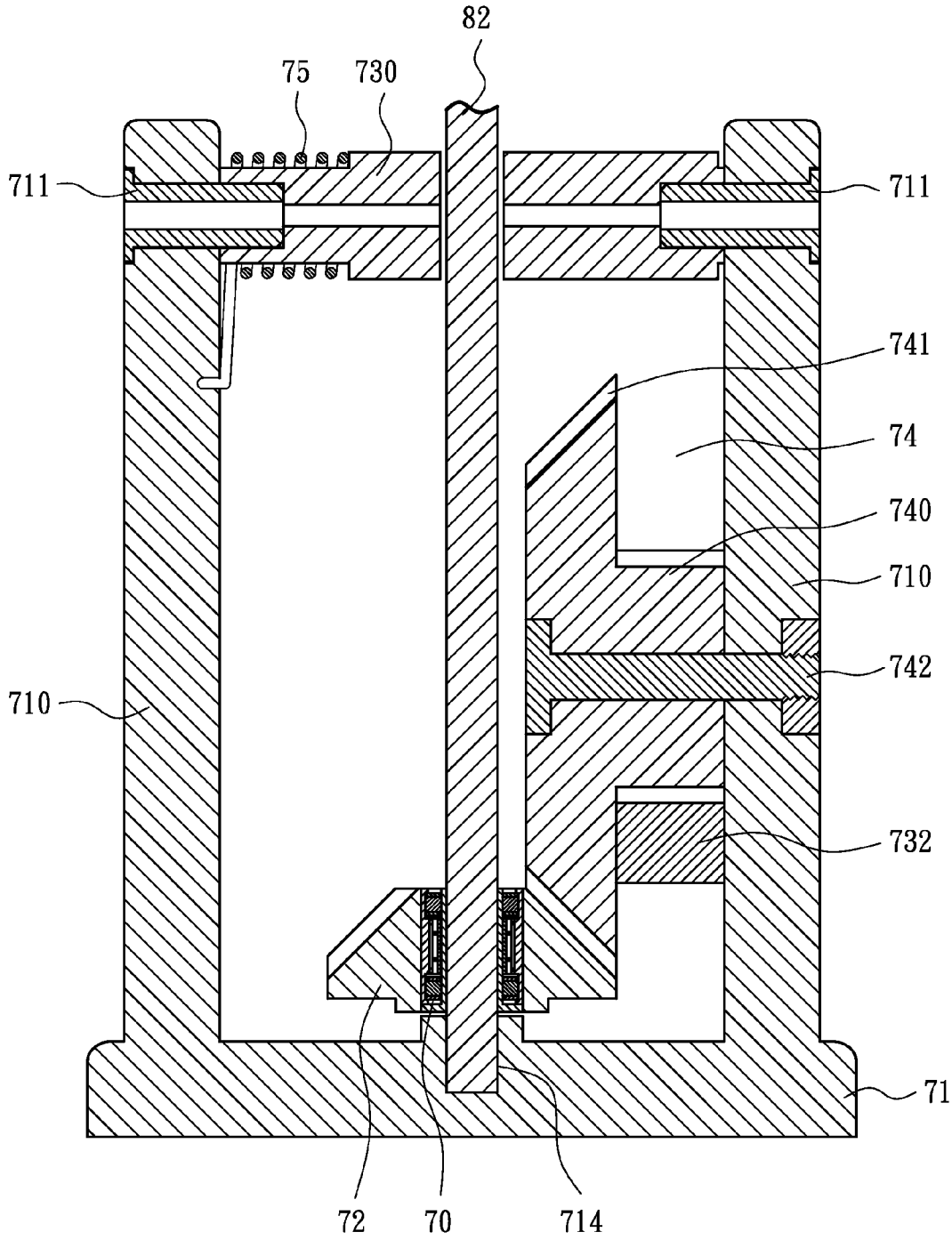
FIG. 12 is a longitudinal sectional view of the assembled actuation mechanism of FIG. 11.
Figure 13:
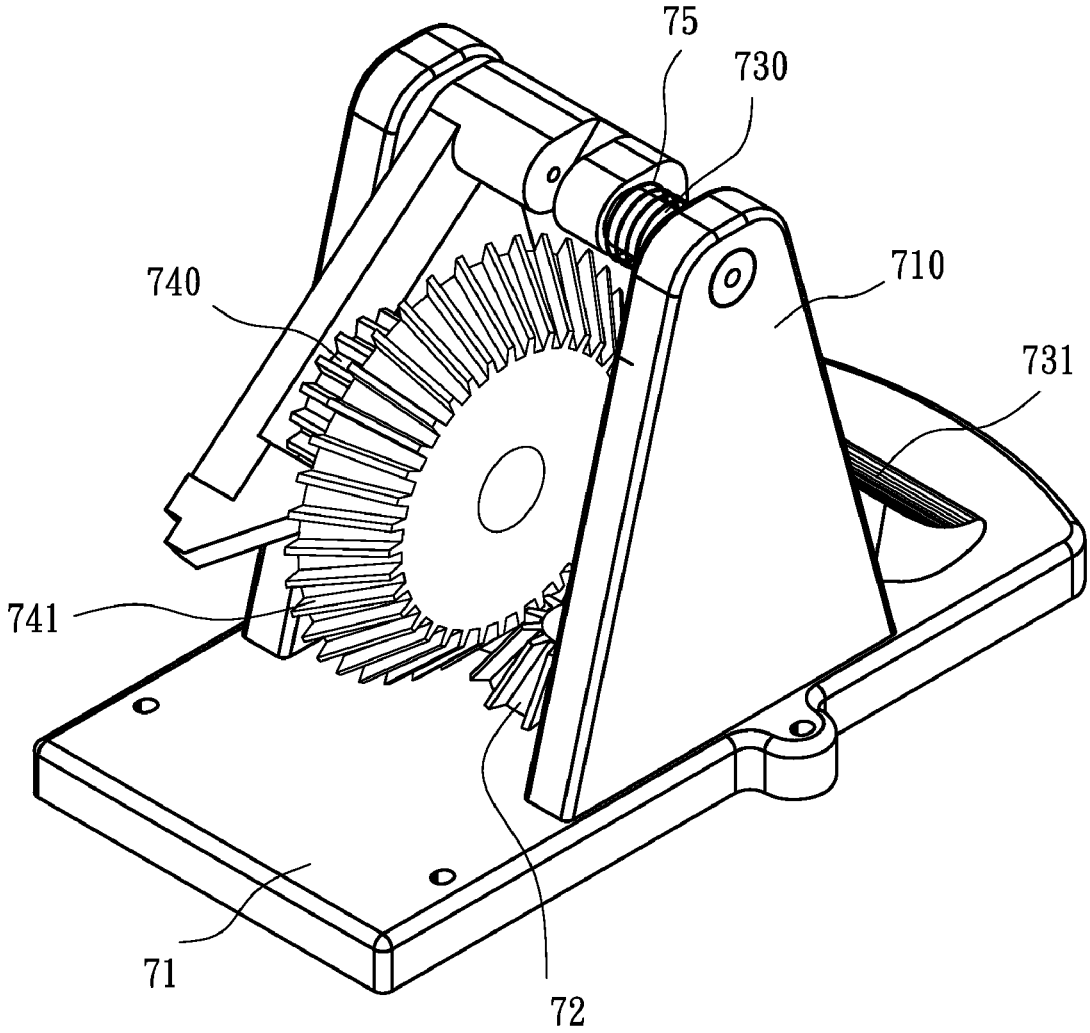
FIG. 13 is a perspective view of the actuation mechanism of FIG. 12.
Figure 14:
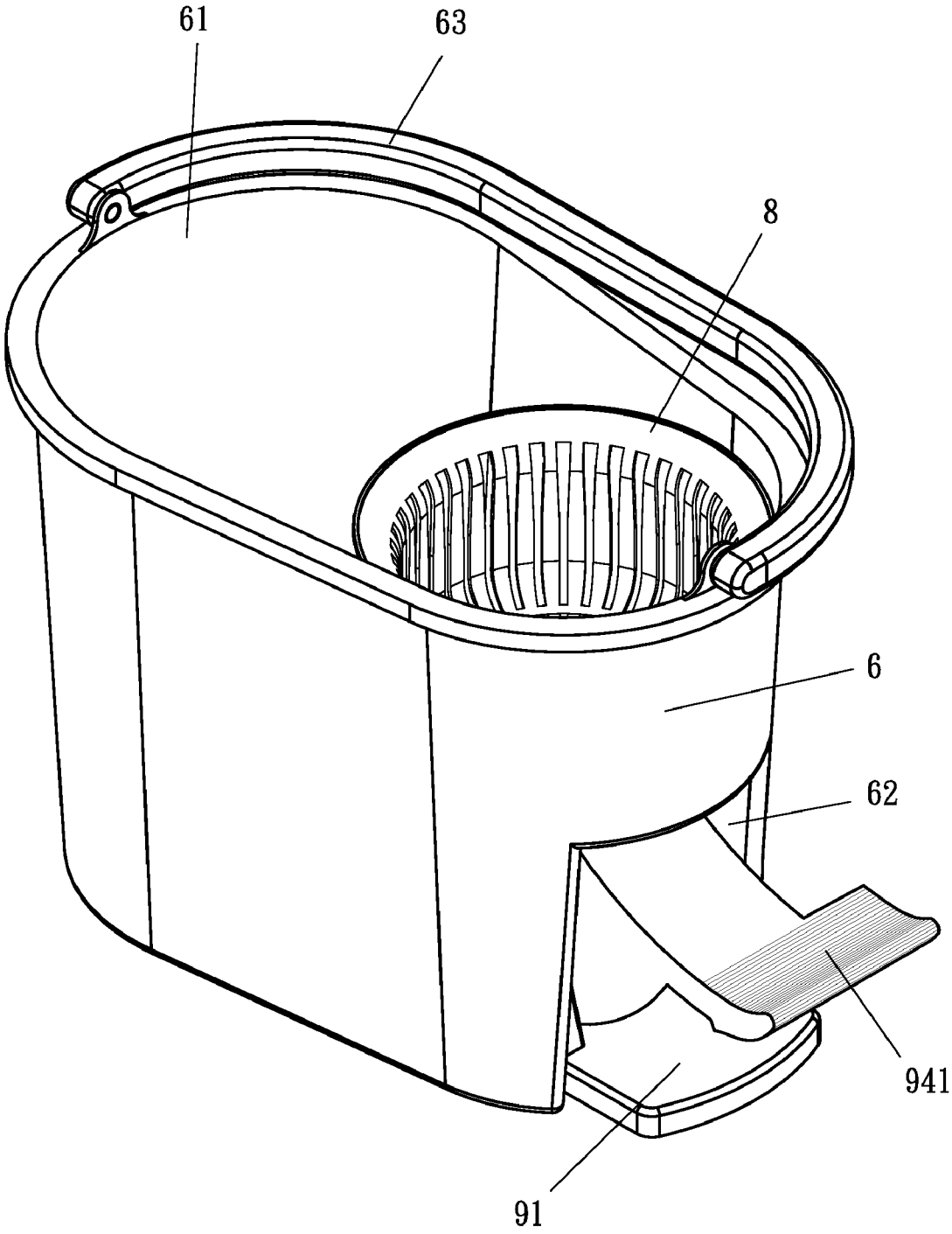
FIG. 14 is a perspective view of a wringer constructed in accordance with a second preferred embodiment of the invention.
Figure 15:
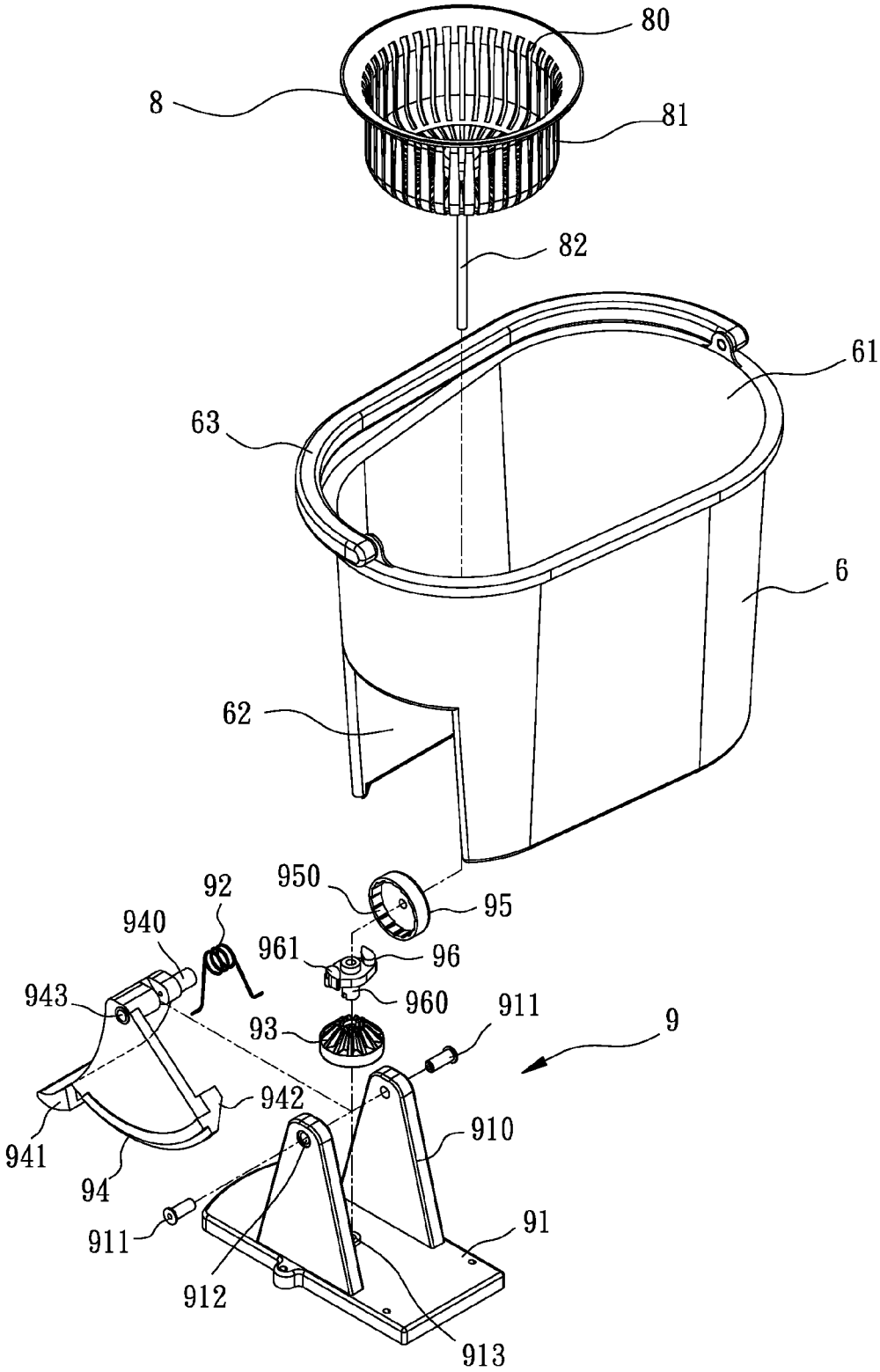
FIG. 15 is an exploded view of FIG. 14.
Figure 16:
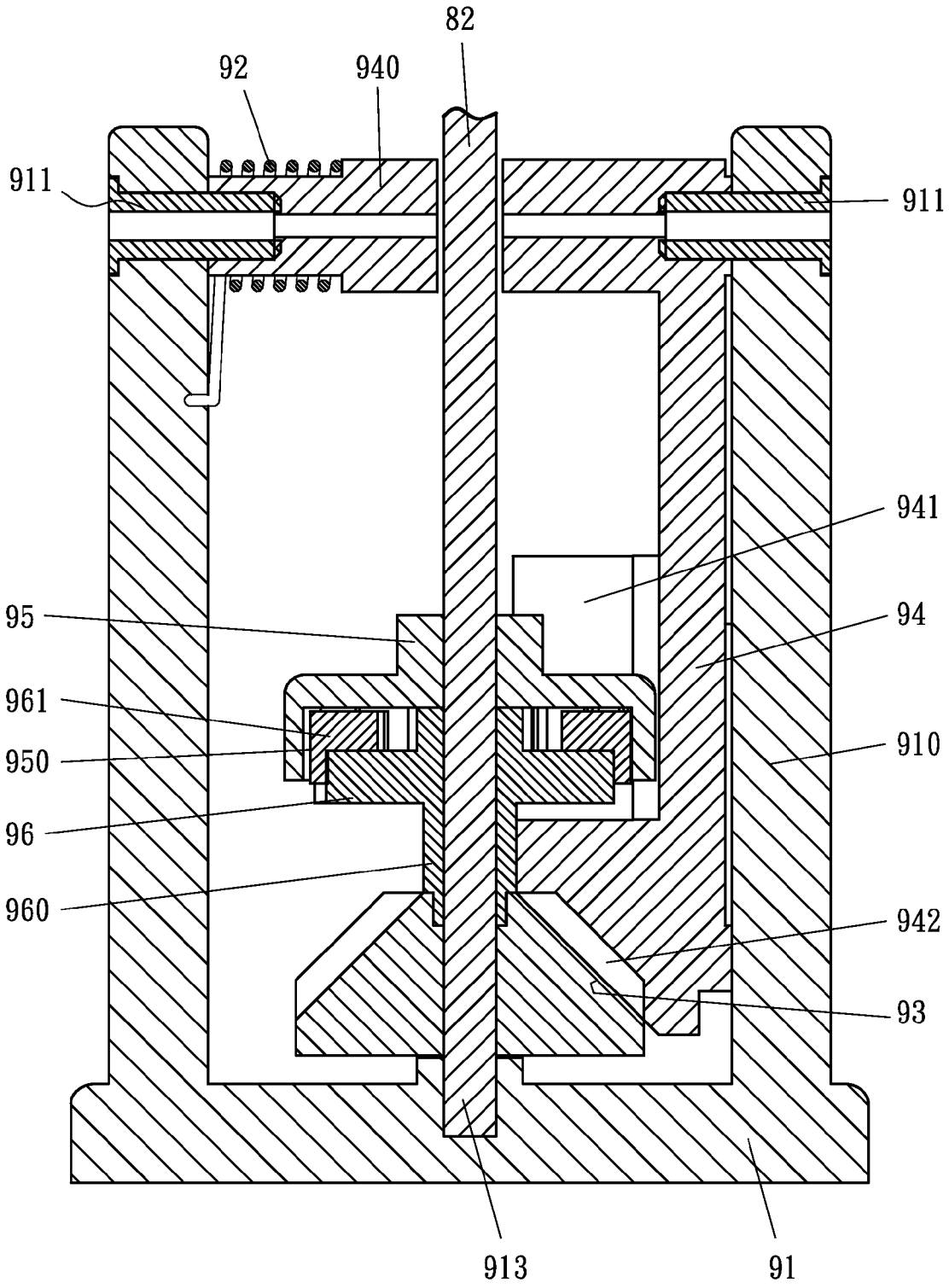
FIG. 16 is a longitudinal sectional view of the assembled actuation mechanism of FIG. 15.
Figure 17:
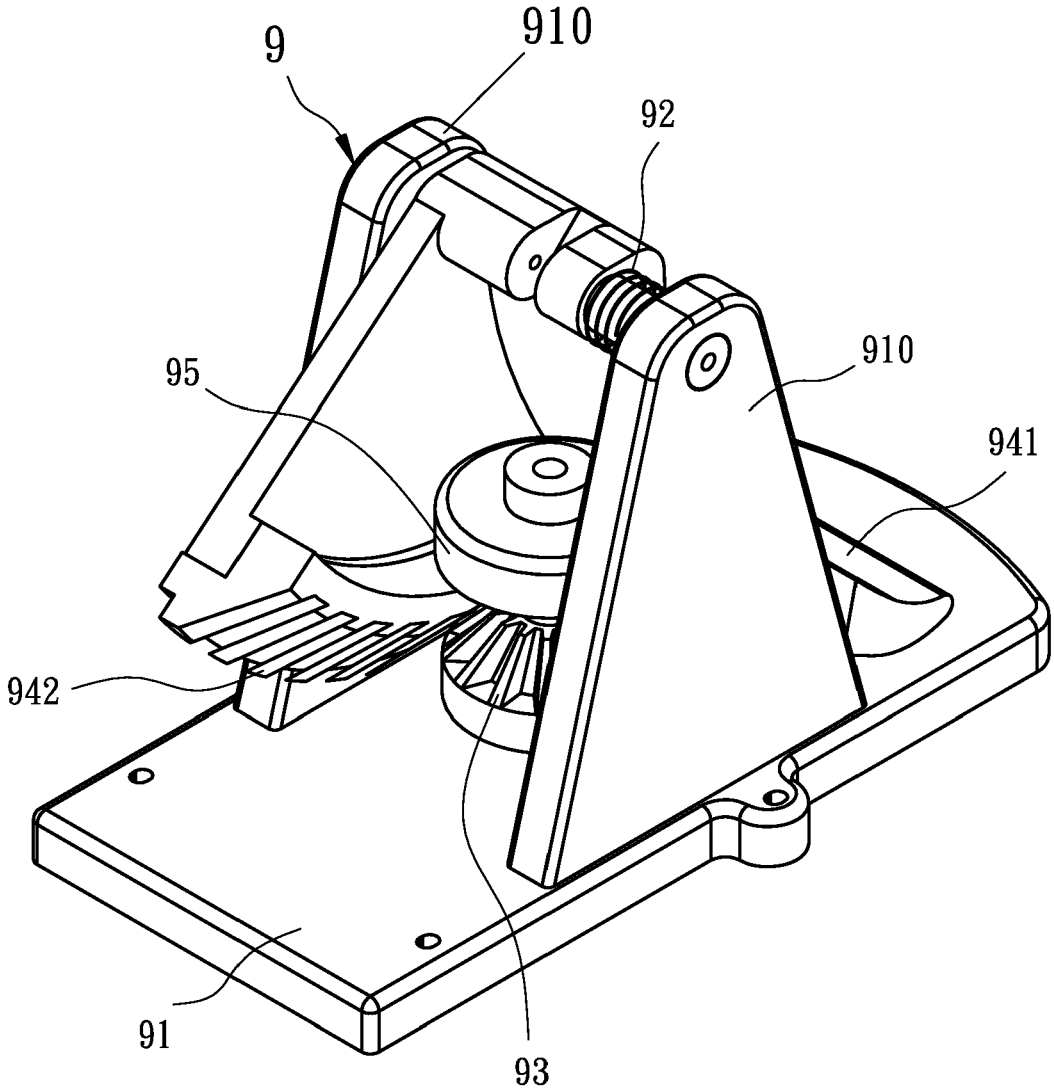
FIG. 17 is a perspective view of the actuation mechanism of FIG. 16.

Referring to FIG. 1, a mop and wringer combination in accordance with the invention is shown.

Referring to FIGS. 2 to 9 in conjunction with FIG. 1, the mop comprises an elongate handle 1 having a lower end 11; and a hinge connector 2 formed of plastic and comprising an upper sleeve 21 adapted to secured to the lower end 11, a lower hinge 22, a lower, curved member 23 integrally formed on the hinge 22, the curved member 23 having a half-spherical protrusion 231 on its lowest point, and a curved groove 24 formed in the curved member 23 and being substantially parallel to the curved outer surface of the curved member 23. Hence, a portion of the curved member 23 between the groove 24 and the protrusion 231 is flexible.

The mop further comprises a yoke 3 including a disc member 33, two opposite yoke arms (not numbered) on the disc member 33 with a channel 31 defined therebetween, the channel 31 having a circular recess 311 on the bottom, a separate ring 34 having a circular flange (not numbered) on the top edge, and a pin 32 inserted through upper holes (not numbered) of the yoke arms and a hole (not numbered) of the hinge 22 to pivotably secure the yoke 3 and the hinge connector 2 together. Further, the protrusion 231 is matingly engaged with the recess 311.

The mop further comprises a circular rotatable disk member 4 including a central through hole 41, a downward first circular flange 42 on the bottom edge, a downward second circular flange 43 adjacent the first circular flange 42 to define an annular trough (not numbered) therebetween, and a downward third circular flange 44 formed between the second circular flange 43 and the through hole 41. That is, the flanges 42, 43, and 44 are concentric. A circular area defined by the third circular flange 44 is adapted to loosely receive the disc member 33 therein after inserting the yoke 3 through the through hole 41. The bottom of the disc member 33 is flush with that of the third circular flange 44. Thereafter, the ring 34 is adapted to cling onto the third circular flange 44 to enclose both the third circular flange 44 and the disc member 33 and retain the disc member 33 in the area defined by the third circular flange 44.

The mop further comprises a ring-shaped mop swab 5 comprising an annular inner flange 56, an upper groove (not numbered) with concentric walls (not numbered), a plurality of ribs 55 for dividing the groove into a plurality of arcuate sections (not numbered) each including two elongate holes 52 on the bottom, a plurality of sets of four triangular members 53, each set of four triangular members 53 being disposed around the hole 52, and strands 54 having one ends fastened in the triangular members 53 after inserting through the holes 52. The mop swab 5 is secured to the rotatable disk member 4 by snapping into the trough defined between the second circular flange 43 and the first circular flange 42.

The rotatable disk member 4 is adapted to rotate about the yoke 3 (i.e., both the rotatable disk member 4 and the mop swab 5 being rotatable about the yoke 3 with the handle 1, the hinge connector 2, and the yoke 3 being motionless during the rotation). An operator may pivot the hinge connector 2 a predetermined angle about the yoke 3 by pushing the handle 1 with the protrusion 231 being removed from the recess 311 until the hinge connector 2 is stopped by the yoke 3. It is understood that the protrusion 231 is capable of flexibly disengaging from the recess 311 because the hinge connector 2 is of molded plastic and the provision of the groove 24.

Referring to FIGS. 10 to 13 in conjunction with FIG. 1, the wringer in accordance with a first preferred embodiment of the invention is shown. The wringer comprises a pail 6 comprising a handle 63 hingedly provided on the top edge, an internal space 61, and a recess 62 on the peripheral wall.

The wringer further comprises a rotatable mop receptacle 8 disposed in the space 61. The mop receptacle 8 comprises a shell 81 having a flared open top, a tapered bottom, and a plurality of longitudinal holes 80, and a shaft 82 extending downward a predetermined length from the bottom center of the shell 81.

The wringer further comprises an actuation mechanism 7 comprising a substantially rectangular support 71 including a bossed hole 714 on the bottom and two substantially triangular upright mounts 710 on two sides respectively, each mount 710 having an upper hole 712 and one of the mounts 710 additionally having an intermediate hole 713 right below the hole 712.

The actuation mechanism 7 further comprises a pivot member 73 including an arcuate foot step 731 disposed in the recess 62 and extending out of the recess 62 a predetermined distance, an arcuate toothed member 732 provided opposing the foot step 731, a pivot shaft 730 provided above the toothed member 732, and a hole 733 provided opposing the pivot shaft 730; and a spring (e.g., torsion spring) 75 put on the pivot shaft 730. The spring 75 has one end urged against one mount 710 and the other end urged against the foot step 731. Further, two pins 711 are provided in which one pin 711 is inserted through one upper hole 712 into the hole 733, and the other pin 711 is inserted through the other upper hole 712 into the pivot shaft 730. As a result, the pivot member 73 and the support 71 are pivotably secured together.

The actuation mechanism 7 further comprises a gear assembly 74 including a small gearwheel 740 in mesh with the toothed member 732, a large first bevel gear 741 being coaxial and integral with the gearwheel 740, and a threaded fastener (e.g., bolt) 742 driven through both the gearwheel 740 and the first bevel gear 741 into the intermediate hole 713 to secure to a nut (not numbered); a small second bevel gear 72 meshed with the first bevel gear 741, the second bevel gear 72 having a longitudinal hole (not numbered) with pawls (not numbered) provided on the inner surface thereof; and a hollow, cylindrical ratchet member 70 provided in the longitudinal hole of the second bevel gear 72 and being in ratchet engagement therewith.

The shaft 82 is inserted through an upper gap between the pivot shaft 730 and the hole 733 and the ratchet member 70 to rotatably anchor in the bossed hole 714 in which the shaft 82 is secured to the ratchet member 70 (i.e., they can co-rotate).

In a wringing operation, an operator may first dispose the wet strands 54 in the shell 81. Next, the operator may set one foot on the foot step 731 to press same by pivoting. Hence, the toothed member 732 rotates counterclockwise. And in turn, the gearwheel 740, the first bevel gear 741, the second bevel gear 72, the ratchet member 70, and the shaft 82 rotate with elastic force being stored in the spring 75. Hence, both the shell 81 and the strands 54 rotate counterclockwise in high speed. As a result, water in the strands 54 leaves the shell 81 via the holes 80 due to strong centrifugal force.

The spring 75 immediately releases its stored elastic energy after leaving the foot out of the foot step 731. Hence, the toothed member 732 rotates clockwise. And in turn, the gearwheel 740, the first bevel gear 741, and the second bevel gear 72 rotate in an opposite direction. But the ratchet member 70 does not rotate because it is not driven by the second bevel gear 72 due to the ratchet disengagement therewith. That is, the shaft 82 remains motionless. This can prevent both the shell 81 and the strands 54 from rotating clockwise. Finally, the foot step 731 returns to its initial condition. The operator may repeat the above steps until the strands 54 are sufficiently wrung.

Referring to FIGS. 14 to 17 in conjunction with FIG. 1, a wringer in accordance with a second preferred embodiment of the invention is shown. The characteristics of the second preferred embodiment are detailed below. The wringer comprises a pail 6 comprising a handle 63 hingedly provided on the top edge, an internal space 61, and a recess 62 on the peripheral wall.

The wringer further comprises a rotatable mop receptacle 8 disposed in the space 61. The mop receptacle 8 comprises a shell 81 having a flared open top, a tapered bottom, and a plurality of longitudinal holes 80, and a shaft 82 extending downward a predetermined length from the bottom center of the shell 81.

The wringer further comprises an actuation mechanism 9 comprising a substantially rectangular support 91 including a bossed hole 913 on the bottom and two substantially triangular upright mounts 910 on two sides respectively, each mount 910 having an upper hole 912.

The actuation mechanism 9 further comprises a pivot member 94 including an arcuate foot step 941 disposed in the recess 62 and extending out of the recess 62 a predetermined distance, an arcuate toothed member 942 provided opposing the foot step 941, a pivot shaft 940 provided above the toothed member 942, and a hole 943 provided opposing the pivot shaft 940; and a spring (e.g., torsion spring) 92 put on the pivot shaft 940. The spring 92 has one end urged against one mount 910 and the other end urged against the foot step 941. Further, two pins 911 are provided in which one pin 911 is inserted through one upper hole 912 into the hole 943, and the other pin 911 is inserted through the other upper hole 912 into the pivot shaft 940. As a result, the pivot member 94 and the support 91 are pivotably secured together.

The actuation mechanism 9 further comprises a hollow gearwheel 93 in mesh with the toothed member 942; a ratchet member 96 including a downward peg 960 secured to a counter bore (not numbered) on the top of the gearwheel 93, and two opposite upper members 961; an inverted cup shaped member 95 including pawls 950 on an inner circumferential surface. The pawls 950 are in ratchet engagement with the upper members 961.

The shaft 82 is inserted through an upper gap between the pivot shaft 940 and the hole 943, the inverted cup shaped member 95, the ratchet member 96, and the gearwheel 93 to rotatably anchor in the bossed hole 913 in which the shaft 82 is secured to the inverted cup shaped member 95.

In a wringing operation, an operator may first dispose the wet strands 54 in the shell 81. Next, the operator may set one foot on the foot step 941 to press same by pivoting. Hence, the toothed member 942 rotates counterclockwise. And in turn, the gearwheel 93, the ratchet member 96, the inverted cup shaped member 95, and the shaft 82 rotate with elastic force being stored in the spring 92. Hence, both the shell 81 and the strands 54 rotate counterclockwise in high speed. As a result, water in the strands 54 leaves the shell 81 via the holes 80 due to strong centrifugal force.

The spring 92 immediately releases its stored elastic energy after leaving the foot out of the foot step 941. Hence, the toothed member 942 rotates clockwise. And in turn, both the gearwheel 93 and the ratchet member 96 rotate in an opposite direction. But the inverted cup shaped member 95 does not rotate because it is not driven by the ratchet member 96 due to the ratchet disengagement therewith. That is, the shaft 82 remains motionless. This can prevent both the shell 81 and the strands 54 from rotating clockwise. Finally, the foot step 941 returns to its initial condition. The operator may repeat the above steps until the strands 54 are sufficiently wrung.

While the invention herein disclosed has been described by means of specific embodiments, numerous modifications and variations could be made thereto by those skilled in the art without departing from the scope and spirit of the invention set forth in the claims.

What is claimed is:

1. A mop and wringer combination comprising:

a mop comprising an elongate handle having a lower hinge connector formed of plastic, the hinge connector having a lower, curved member with a protrusion on its lowest point and a curved groove being substantially parallel to the outer surface of the curved member; a yoke including a disc member, two opposite yoke arms on the disc member with a channel defined therebetween, the channel having a bottom recess and the curved member being pivotably fastened in the channel and the recess being matingly engaged with the protrusion, and a ring having an annular flange on the top edge; a circular rotatable disk member including a central through aperture, an annular trough on the bottom edge, and a downward annular flange disposed between the trough and the through aperture wherein the disc member is loosely receive in an area defined by the annular flange after inserting the yoke through the through aperture, and the ring is clung onto the annular flange retain the disc member therein; and a ring-shaped mop swab comprising a plurality of arcuate sections around the top edge, each arcuate section comprising at least one hole and fastening means, and a plurality of strands having one ends fastened in the fastening means after inserting through the at least one hole wherein the mop swab is secured to the rotatable disk member by snapping the arcuate sections into the trough, wherein both the rotatable disk member and the mop swab are adapted to rotate about the yoke with the handle and the yoke being motionless during the rotation; and the hinge connector is adapted to pivot a predetermined angle about the yoke by pushing the handle with the protrusion clearing the recess until the hinge connector is stopped by the yoke; and a wringer comprising a pail having a recess on the peripheral wall; a rotatable mop receptacle disposed in the pail, the mop receptacle comprising a plurality of longitudinal holes and a downward extending shaft; and an actuation mechanism comprising a support, a spring-biased pivot member pivotably secured to the support and comprising a foot step disposed in the recess and extending out of the recess a predetermined distance and an arcuate toothed member opposing the foot step, a gear assembly rotatably secured to the support and comprising a gearwheel meshed with the toothed member, a first bevel gear being coaxial with the gearwheel, a second bevel gear meshed with the first bevel gear, the second bevel gear having a longitudinal bore with pawls disposed on a surface of the longitudinal bore, and a ratchet member disposed in the longitudinal bore of the second bevel gear and being in ratchet engagement with the pawls, wherein the shaft is securely inserted through the ratchet member to rotatably anchor on the bottom of the support, wherein in response to disposing the wet strands in the mop receptacle and pressing the foot step the toothed member rotates in a first direction to cause both the ratchet member and the shaft to rotate in the first direction via the gear connection of the gearwheel, the first bevel gear, and the second bevel gear, thereby wringing the strands by rotating both the mop receptacle and the strands in the first direction; and wherein in response to releasing the foot step to return to its initial position the toothed member rotates in a second direction opposing the first direction to cause the second bevel gear to rotate in the second direction via the gear connection of the gearwheel, the first bevel gear, and the second bevel gear and cause both the ratchet member and the mop receptacle to stop rotating by ratchet disengagement the ratchet member from the second bevel gear.

2. A mop and wringer combination comprising:

a mop comprising an elongate handle having a lower hinge connector formed of plastic, the hinge connector having a lower, curved member with a protrusion on its lowest point and a curved groove being substantially parallel to the outer surface of the curved member; a yoke including a disc member, two opposite yoke arms on the disc member with a channel defined therebetween, the channel having a bottom recess and the curved member being pivotably fastened in the channel and the recess being matingly engaged with the protrusion, and a ring having an annular flange on the top edge; a circular rotatable disk member including a central through aperture, an annular trough on the bottom edge, and a downward annular flange disposed between the trough and the through aperture wherein the disc member is loosely receive in an area defined by the annular flange after inserting the yoke through the through aperture, and the ring is clung onto the annular flange retain the disc member therein; and a ring-shaped mop swab comprising a plurality of arcuate sections around the top edge, each arcuate section comprising at least one hole and fastening means, and a plurality of strands having one ends fastened in the fastening means after inserting through the at least one hole wherein the mop swab is secured to the rotatable disk member by snapping the arcuate sections into the trough, wherein both the rotatable disk member and the mop swab are adapted to rotate about the yoke with the handle and the yoke being motionless during the rotation; and the hinge connector is adapted to pivot a predetermined angle about the yoke by pushing the handle with the protrusion clearing the recess until the hinge connector is stopped by the yoke; and a wringer comprising a pail having a recess on the peripheral wall; a rotatable mop receptacle disposed in the pail, the mop receptacle comprising a plurality of longitudinal holes and a downward extending shaft; and an actuation mechanism comprising a support, a spring-biased pivot member pivotably secured to the support and comprising a foot step disposed in the recess and extending out of the recess a predetermined distance and an arcuate toothed member opposing the foot step, a gear assembly rotatably fastened on the support and comprising a bevel gear meshed with the toothed member, a ratchet member secured onto the gearwheel, and a pawl member being in ratchet engagement with the ratchet member, wherein the shaft is securely inserted through the pawl member, the ratchet member, and the bevel gear to rotatably anchor on the bottom of the support, wherein in response to disposing the wet strands in the mop receptacle and pressing the foot step the toothed member rotates in a first direction to cause both the pawl member and the shaft to rotate in the first direction via the bevel gear and the ratchet member, thereby wringing the strands by rotating both the mop receptacle and the strands in the first direction; and wherein in response to releasing the foot step to return to its initial position the toothed member rotates in a second direction opposing the first direction to cause the bevel gear to rotate in the second direction and cause both the pawl member and the mop receptacle to stop rotating by ratchet disengagement the ratchet member from the pawl member.

* * * * *